US009366471B2

(12) United States Patent
Allen

(10) Patent No.: US 9,366,471 B2
(45) Date of Patent: Jun. 14, 2016

(54) APPLIANCE AND A HANDLE ASSEMBLY FOR AN APPLIANCE

(71) Applicant: General Electric Company, Schenectady, NY (US)

(72) Inventor: Brian Dean Allen, The Villages, FL (US)

(73) Assignee: General Electric Company, Schenectady, NY (US)

( * ) Notice: Subject to any disclaimer, the term of this patent is extended or adjusted under 35 U.S.C. 154(b) by 189 days.

(21) Appl. No.: 14/068,289

(22) Filed: Oct. 31, 2013

(65) Prior Publication Data

US 2015/0115785 A1 Apr. 30, 2015

(51) Int. Cl.

| | |
|---|---|
| ***A47B 96/04*** | (2006.01) |
| ***F25D 23/02*** | (2006.01) |
| ***E05B 1/00*** | (2006.01) |
| ***E05B 65/00*** | (2006.01) |

(52) U.S. Cl.

CPC ..... *F25D 23/028* (2013.01); *E05B 1/0015* (2013.01); *E05B 65/0042* (2013.01); *A47B 2220/0047* (2013.01); *Y10T 16/458* (2015.01)

(58) Field of Classification Search

CPC ..... F25D 23/028; F25D 23/02; E05B 1/0015; Y10T 16/458; Y10T 16/498; Y10T 16/444; Y10T 292/096; Y10T 292/0969

USPC ..... 292/169.18; 280/508

See application file for complete search history.

(56) References Cited

U.S. PATENT DOCUMENTS

| | | | | |
|---|---|---|---|---|
| 3,648,411 | A * | 3/1972 | Saunders | E05B 1/0015 16/412 |
| 2008/0034553 | A1* | 2/2008 | Wing | E05B 1/0015 16/412 |
| 2010/0232925 | A1* | 9/2010 | Cullum | B60D 1/26 414/800 |
| 2011/0215694 | A1* | 9/2011 | Fink | E05B 1/0015 312/405 |
| 2011/0220662 | A1* | 9/2011 | Kim | F25D 23/028 220/592.02 |

FOREIGN PATENT DOCUMENTS

| | | | |
|---|---|---|---|
| CN | 102864970 | A | 1/2013 |

* cited by examiner

*Primary Examiner* — Daniel J Troy
*Assistant Examiner* — Andres F Gallego
(74) *Attorney, Agent, or Firm* — Dority & Manning, P.A.

(57) ABSTRACT

A handle assembly for mounting to a door of an appliance includes a tubular main body and an insert received within the tubular main body. A pin is disposed within a passage of the insert. A distal end of the pin engages a projection. The insert, pin and bracket can assist with mounting the tubular main body to the appliance.

16 Claims, 8 Drawing Sheets

APPLIANCE AND A HANDLE ASSEMBLY FOR AN APPLIANCE

FIELD OF THE INVENTION

The present disclosure relates generally to appliances, such as refrigerator appliances, and handle assemblies for the same.

BACKGROUND OF THE INVENTION

Certain residential and commercial appliances, such as refrigerator appliances, include a housing that defines one or more compartments for storage of articles therein. Exterior and interior doors and/or drawers can be provided for accessing the compartments. One or more handles are typically provided for manipulating such doors and drawers. Fasteners may be used to attach the handles or, in other constructions, the handles may be formed integrally with the doors.

For certain applications, shipping an appliance without one or more of the handles installed may be desirable. For example, shipping the appliance with the handle already installed can increase the footprint of the appliance. Additionally, installed handles can increase the amount of packaging materials required for protecting the appliance during shipping. For instance, a handle that protrudes from the appliance may need special packaging to prevent damage during shipping.

Challenges exist, however, with providing one or more handles to be installed by a retailer or purchaser of the appliance. Commonly used handle constructions may require special tools and/or skills that the retailer or purchaser may not possess. In addition, the installation process may require multiple steps and/or the presence of more than one person. Such factors may lead the retailer or purchaser to incorrectly install the handle or not even attempt installation, which in turn can lead to service calls and/or dissatisfaction with the appliance.

Also, where the handle assembly requires multiple parts, particularly small fasteners such as screws, bolts, and washers, such parts are typically shipped with the product. Unfortunately, this requires additional steps during manufacture and packaging. Additionally, such parts may be lost by the retailer or purchaser prior to, or during, installation.

Accordingly, a handle assembly for an appliance that can be shipped with the appliance uninstalled would be useful. A handle assembly with features that allow for installation without the use of tools and/or multiple small parts would also be useful. Such a handle assembly that can be used on a door, drawer, or component of a variety of different appliance types would be particularly beneficial.

BRIEF DESCRIPTION OF THE INVENTION

The present subject matter provides an appliance and a handle assembly for an appliance. The handle assembly includes a tubular main body and an insert received within the tubular main body. A pin is disposed within a passage of the insert. A distal end of the pin engages a projection. The insert, pin and bracket can assist with mounting the tubular main body to the appliance. Additional aspects and advantages of the invention will be set forth in part in the following description, or may be apparent from the description, or may be learned through practice of the invention.

In a first exemplary embodiment, an appliance is provided. The appliance includes a cabinet that defines a chilled chamber and a door mounted to the cabinet. The door has an outer panel. A handle assembly is mounted to the door. The handle assembly includes a tubular main body that extends between a first end portion and a second end portion. The first and second end portions of the tubular main body are positioned at the outer panel of the door. The tubular main body defines an opening at the first end portion of the tubular main body. An insert is received within the tubular main body at the first end portion of the tubular main body. The insert has a mounting surface positioned at the opening of the tubular main body. The mounting surface is positioned proximate the outer panel of the door. The insert defines a channel that extends inwardly from the mounting surface of the insert. The insert also defines a passage. A pin is slidably disposed within the passage of the insert. The pin has a distal end. A biasing mechanism urges the distal end of the pin towards the channel of the insert. A bracket is mounted to the door. The bracket has a projection that defines a hole. The projection is disposed within the channel of the insert. The distal end of the pin is at least partially positioned within the hole of the projection.

In a second exemplary embodiment, a handle assembly for an appliance is provided. The handle assembly includes a tubular main body that extends between a first end portion and a second end portion. The tubular main body defines an opening at the first end portion of the tubular main body. An insert is received within the tubular main body at the first end portion of the tubular main body. The insert has a mounting surface positioned at the opening of the tubular main body. The insert defines a channel that extends inwardly from the mounting surface of the insert. The insert also defines a passage. A pin is disposed within the passage of the insert. The pin is movable between a first position and a second position within the passage. The pin has a distal end positioned in the channel of the passage when the pin is in the second position. A biasing mechanism urges the pin towards the second position. A bracket has a projection. The projection is disposed within the channel of the insert. The distal end of the pin engages the projection within the channel of the insert.

In a third exemplary embodiment, an appliance is provided. The appliance includes a cabinet, a door mounted to the cabinet and a handle assembly. The appliance also includes means for removably mounting the handle assembly to the door.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
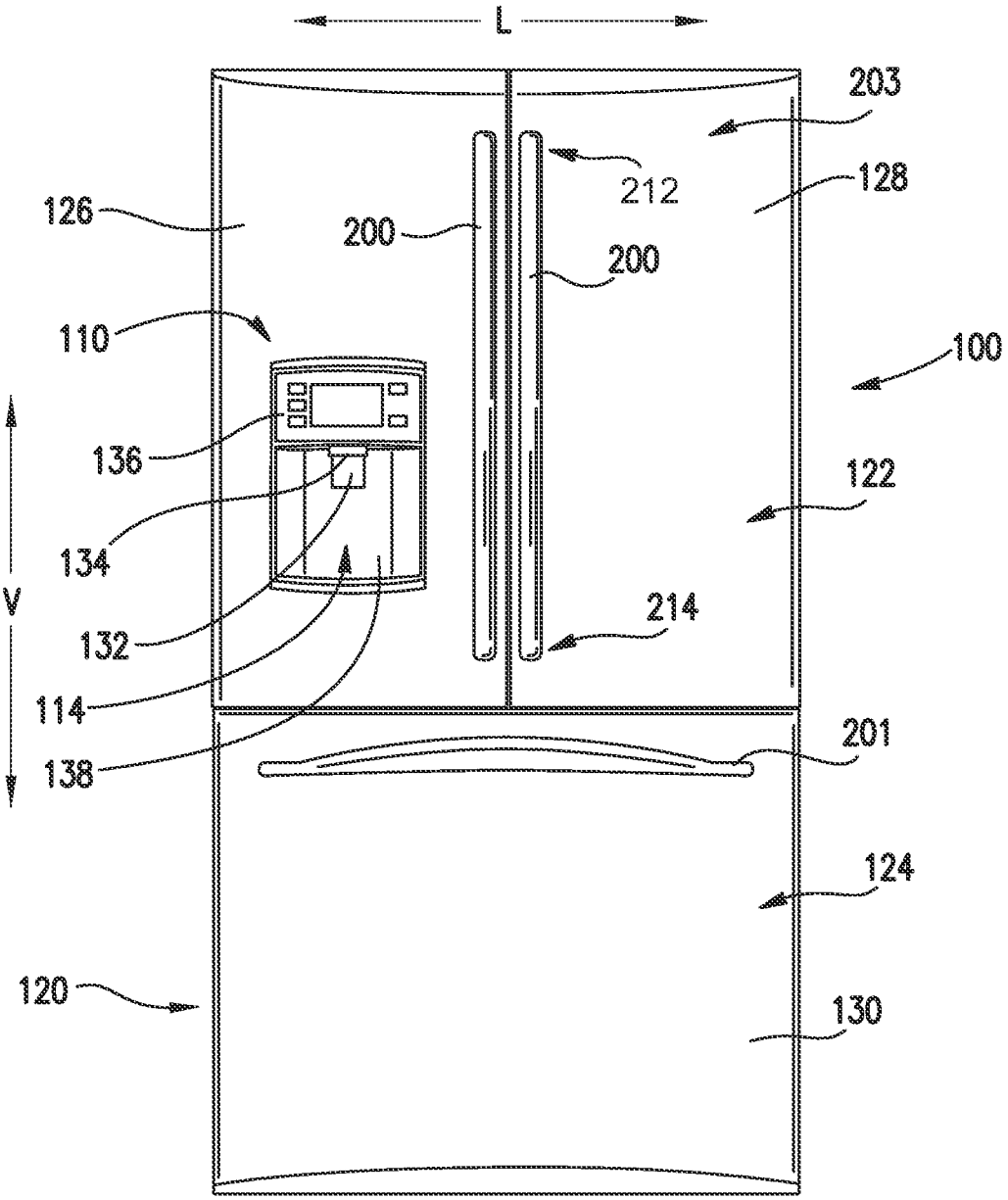
FIG. 1 provides a front, elevation view of a refrigerator appliance according to an exemplary embodiment of the exemplary embodiment.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
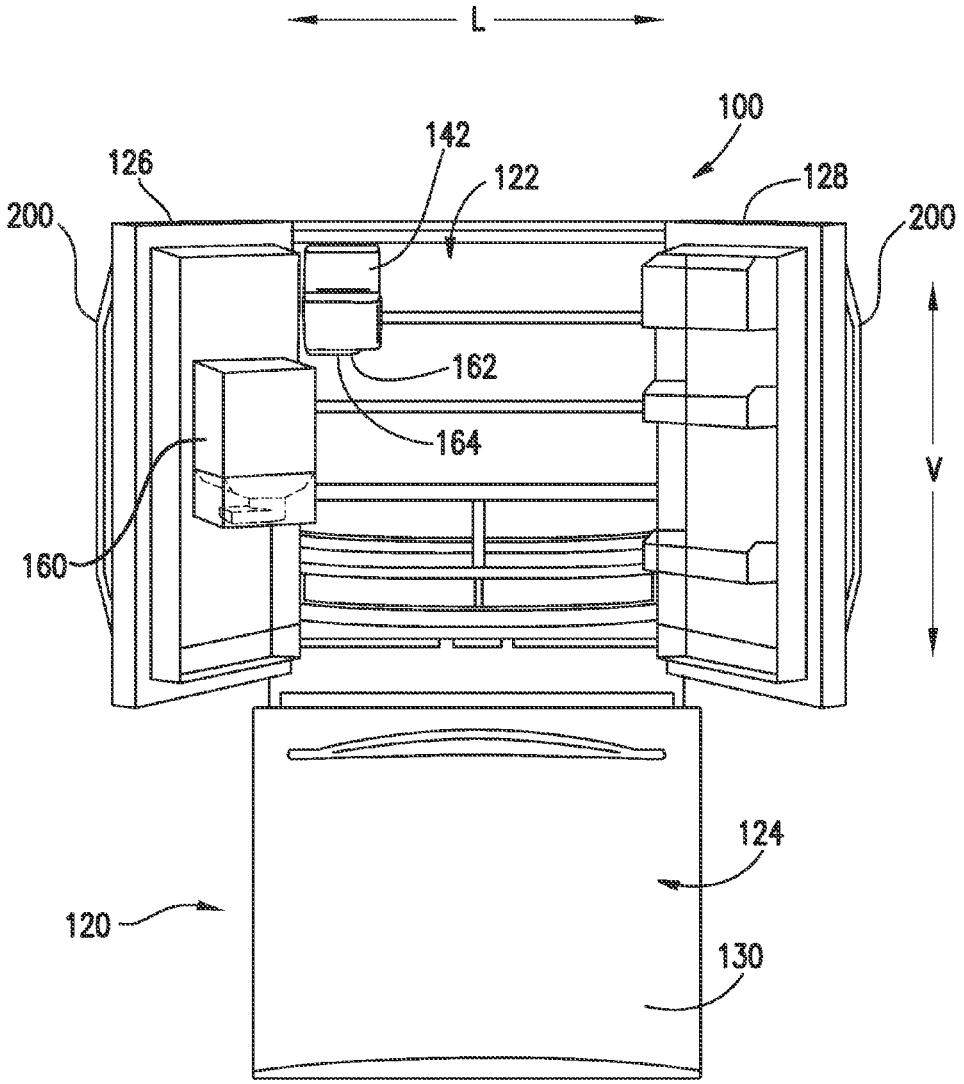
FIG. 2 provides a front, elevation view of the exemplary refrigerator appliance of FIG. 1 with doors of the exemplary refrigerator appliance shown in an open position.

FIG. 1 provides a front, elevation view of a refrigerator appliance 100 according to an exemplary embodiment of the present subject matter. FIG. 2 provides a front, elevation view of refrigerator appliance 100 with refrigerator doors 126 and 128 of refrigerator appliance 100 shown in an open position to reveal a fresh food chamber 122 of refrigerator appliance 100. Refrigerator appliance 100 defines a vertical direction V and a lateral direction L. The vertical direction V and lateral direction L are perpendicular to each other. Refrigerator appliance 100 extends between an upper portion 101 and a lower portion 102 along the vertical direction V. Refrigerator appliance 100 also extends between a first side portion 105 and a second side portion 106 along the lateral direction L.

Refrigerator appliance 100 includes a cabinet or housing 120 that defines chilled chambers for receipt of food items for storage. In particular, refrigerator appliance 100 defines fresh food chamber 122 at upper portion 101 of refrigerator appliance 100 and a freezer chamber 124 arranged below fresh food chamber 122 on the vertical direction V, e.g., at lower portion 102 of refrigerator appliance 100. As such, refrigerator appliance 100 is generally referred to as a bottom mount refrigerator appliance. However, using the teachings disclosed herein, one of skill in the art will understand that the present subject matter may be used with other types of refrigerator appliances (e.g., side-by-side style or top mount style) or a freezer appliance as well. Consequently, the description set forth herein is for illustrative purposes only and is not intended to limit the present subject matter to any particular chilled chamber arrangement or configuration.

Refrigerator doors 126 and 128 are rotatably hinged to an edge of housing 120 for accessing fresh food compartment 122. In particular, refrigerator doors 126 and 128 are rotatably mounted to housing 120 at an opening 121 that permits access to fresh food chamber 122. A freezer door 130 is arranged below refrigerator doors 126 and 128 for accessing freezer chamber 124. Freezer door 130 is coupled to a freezer drawer (not shown) slidably mounted within freezer chamber 124. Handle assemblies 200 and 201 may be used for manipulation of doors 126, 128 and 130. Handle assemblies 200 and 201, for example, are positioned on or at a panel (e.g., outer panel 203) or surfaces forming doors 126, 128, and 130. Further description of the installation and construction of e.g., handle assemblies 200 is provided below.

Refrigerator appliance 100 also includes a dispensing assembly 110 for dispensing liquid water and/or ice. Dispensing assembly 110 includes a dispenser 114 positioned on or mounted to an exterior portion of refrigerator appliance 100, e.g., on refrigerator door 126. Dispenser 114 includes a discharging outlet 134 for accessing ice and liquid water. An actuating mechanism 132, shown as a paddle, is mounted below discharging outlet 134 for operating dispenser 114. In alternative exemplary embodiments, any suitable actuating mechanism may be used to operate dispenser 114. For example, dispenser 114 can include a sensor (such as an ultrasonic sensor) or a button rather than the paddle. A user interface panel 136 is provided for controlling the mode of operation. For example, user interface panel 136 can include user inputs, such as a water dispensing button (not labeled) and an ice-dispensing button (not labeled), for selecting a desired mode of operation such as crushed or non-crushed ice.

Discharging outlet 134 and actuating mechanism 132 are an external part of dispenser 114 and are mounted in a dispenser recess 138. Dispenser recess 138 is positioned at a predetermined elevation convenient for a user to access ice or water and enabling the user to access ice without the need to bend-over and without the need to access freezer chamber 124. In the exemplary embodiment, dispenser recess 138 is positioned at a level that approximates the chest level of a user.

Turning now to FIG. 2, certain components of dispensing assembly 110 are illustrated. Dispensing assembly 110 includes an insulated housing 142 mounted within fresh food chamber 122. Due to the insulation which encloses insulated housing 142, the temperature within insulated housing 142 can be maintained at levels different from the ambient temperature in the surrounding fresh food chamber 122.

Insulated housing 142 is constructed and arranged to operate at a temperature that facilitates producing and storing ice. More particularly, insulated housing 142 contains an ice maker for creating ice and feeding the same to an ice bucket 160 that is mounted on refrigerator door 126. As illustrated in FIG. 2, ice bucket 160 is placed at a vertical position on refrigerator door 126 that will allow for the receipt of ice from a discharge opening 162 located along a bottom edge 164 of insulated housing 142. As refrigerator door 126 is closed or opened, ice bucket 160 is moved in and out of position under insulated housing 142. In alternative exemplary embodiments, insulated housing 142 and the ice maker located therein can be mounted at any other suitable location in refrigerator appliance 100, such as on refrigerator door 126.

Figure 3:
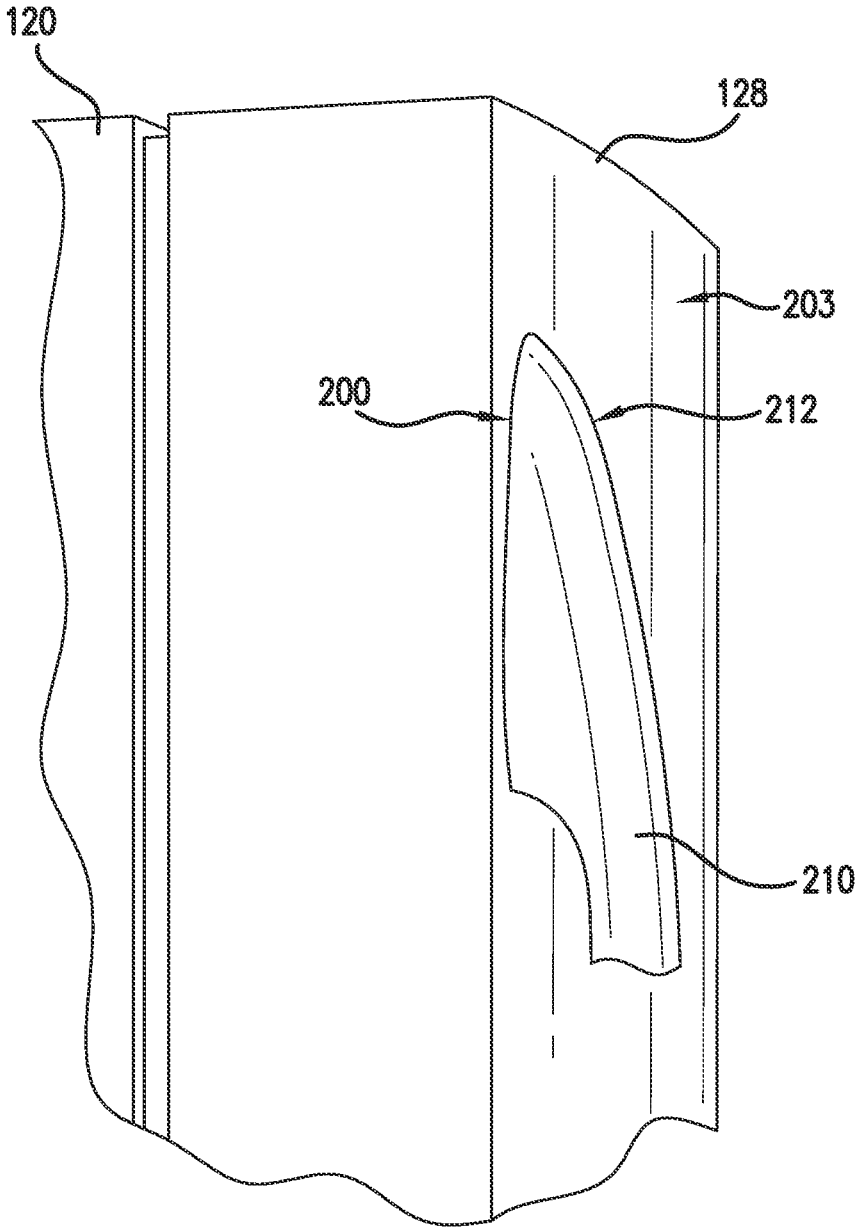
FIG. 3 provides a partial, perspective view of a door of the exemplary refrigerator appliance of FIG. 1 and a handle assembly according to an exemplary embodiment of the exemplary embodiment.

FIG. 3 provides a partial, perspective view of refrigerator door 128 of refrigerator appliance 100 and handle assembly 200. It should be understood that handle assembly 200 can be used on any suitable appliance. For example, handle assembly 200 may be used on a side-by-side style refrigerator appliance, an oven appliance, a freezer appliance, etc. Thus, while described in the context of refrigerator appliance 100, handle assembly 200 is not limited to usage with any particular appliance or style of refrigerator appliance. Construction and installation of handle assembly 200 is described in greater detail below. It should be understood that handle assembly 201 may be constructed and installed in a similar manner to handle assembly 200.

As may be seen in FIG. 3, handle assembly 200 includes a tubular main body 210. Turning back to FIG. 1, tubular main body 210 extends between a first end portion 212 and a second end portion 214. First and second end portions 212 and 214 of tubular main body 210 are spaced apart from each other, e.g., along the vertical direction V. In addition, first and second end portions 212 and 214 of tubular main body 210 are positioned on or at outer panel 203 of refrigerator door 128. Tubular main body 210 also defines an opening 216 (FIG. 6), e.g., at first end portion 212 of tubular main body 210.

A user can grasp tubular main body 210 to adjust refrigerator door 128 between the open and closed positions. Tubular main body 210 can be constructed in any suitable manner and from any suitable material. For example, tubular main body 210 may be constructed of or with stainless steel. As another, example, tubular main body 210 may be constructed of or with a plastic.

Figure 4:
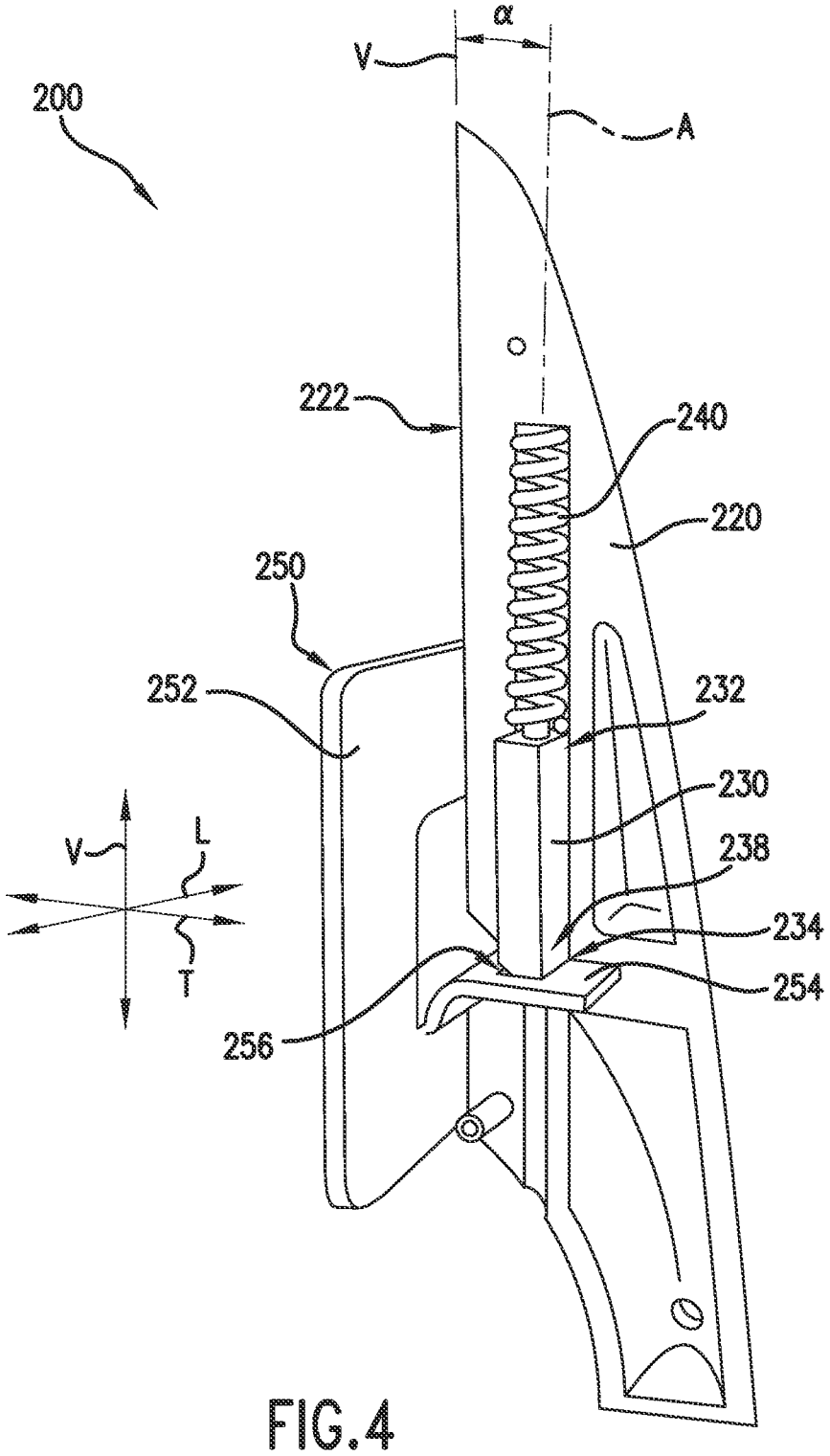
FIG. 4 provides a perspective view of certain components of the exemplary handle assembly of FIG. 3.
Figure 5:
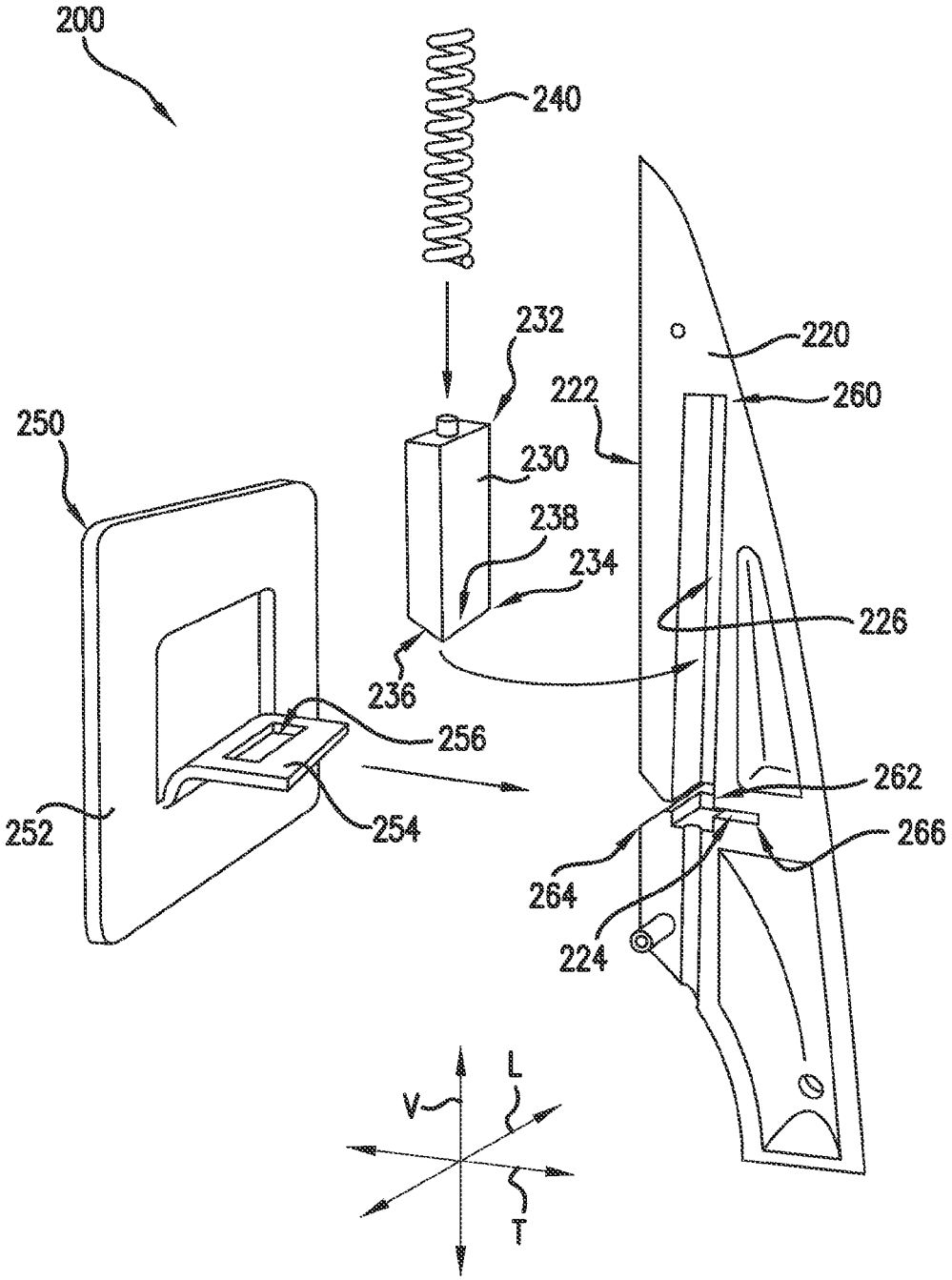
FIG. 5 provides an exploded view of certain components of the exemplary handle assembly of FIG. 3.
Figure 6:
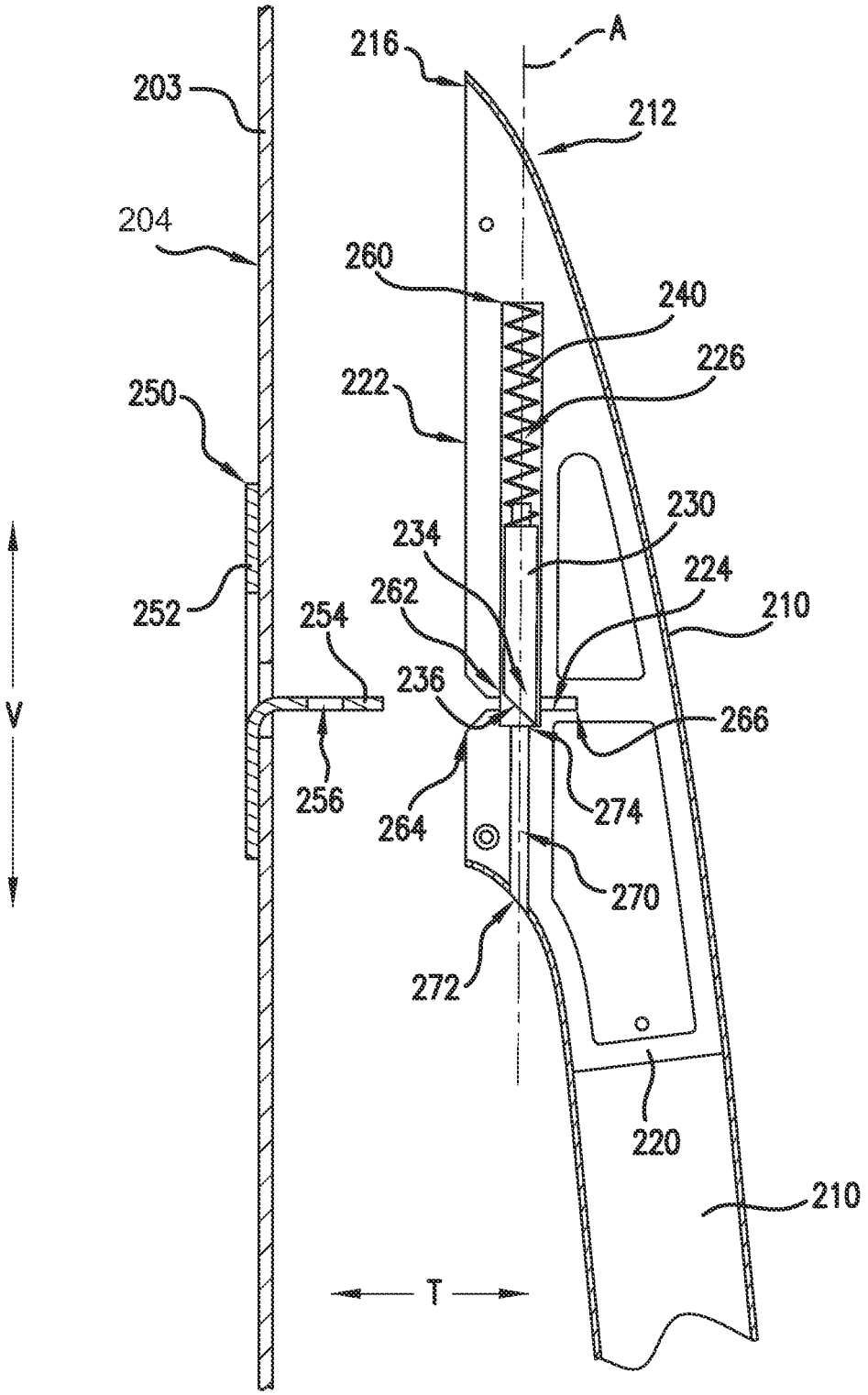
FIGS. 6, 7 and 8 provide partial, section views of the exemplary handle assembly of FIG. 3 shown in various stages of mounting the exemplary handle assembly to the door.

FIG. 4 provides a perspective view of certain components of handle assembly 200. FIG. 5 provides an exploded view of certain components of handle assembly 200. As may be seen in FIGS. 4 and 5, handle assembly 200 includes an insert 220 (half of insert 220 is shown in FIGS. 4 and 5). Insert 220 may be disposed or received within tubular main body 210, e.g., at first end portion 212 of tubular main body 210 as shown in FIG. 6. Insert 220 can be constructed in any suitable manner and from any suitable material. For example, insert 220 may be constructed of or with a plastic.

Insert 220 has a mounting surface 222. Mounting surface 222 may be positioned at or proximate opening 216 of tubular main body 210. Thus, mounting surface 222 may be positioned at or on outer panel 203 of refrigerator door 128 such that mounting surface 222 faces outer panel 203 of refrigerator door 128 from within tubular main body 210. As may be seen in FIG. 5, insert 220 defines a channel 224 and a passage 226. Channel 224 extends inwardly from mounting surface 222.

Turning to FIG. 5, passage 226 extends between a top portion 260 and a bottom portion 262, e.g., along the vertical direction V. Thus, top and bottom portions 260 and 262 of passage 226 are spaced apart from each other, e.g., along the vertical direction V. In particular, passage 226 may extend linearly along the vertical direction V between top and bottom portions 260 and 262 of passage 226. Conversely, channel 224 extends between a front portion 264 and a back portion 266, e.g., along the transverse direction T. Thus, front and back portions 264 and 266 of channel 224 are spaced apart from each other, e.g., along the transverse direction T. In particular, channel 224 may extend linearly along the transverse direction T between front and back portions 264 and 266 of channel 224.

Passage 226 is also angled relative to channel 224. In particular, passage 226 may be angled relative to channel 224 such that passage 226 is not perpendicular to channel 224, e.g., in a plane that is perpendicular to the transverse direction T. Passage 226 can also be angled relative to the vertical direction V. For example, a central axis A of passage 226 and the vertical direction V may define an angle $\alpha$ therebetween. The angle $\alpha$ can be any suitable angle. For example, the angle $\alpha$ may be greater than about five degrees and less than about fifteen degrees.

Handle assembly 200 also includes a pin 230. Pin 230 is, e.g., slidably or movably, disposed within passage 226 of insert 220. Pin 230 extends, e.g., linearly, between a proximal end 232 and a distal end 234. Distal end 234 of pin 230 is positioned at or adjacent bottom portion 262 of passage 226. Pin 230 also includes or defines an angled leading edge 236, e.g., at distal end 234 of pin 230. Angled leading edge 236 of pin 230 faces mounting surface 222 of insert 220, e.g., along the transverse direction T. Pin 230 also includes a surface 238 of pin 230 positioned opposite angled leading edge 236 on pin 230, e.g., along the transverse direction T. Due to the angle $\alpha$, opposite surface 238 can also be angled.

Handle assembly 200 also includes a biasing mechanism 240, e.g., positioned at or adjacent proximal end 232 of pin 230. Biasing mechanism 240 is configured or arranged for urging distal end 234 of pin 230 towards channel 224 of insert 220. Biasing mechanism 240 can be any suitable mechanism. For example, biasing mechanism 240 may be a spring positioned within passage 226 of insert 220 and extending between insert 220 and pin 230 within passage 226.

Handle assembly 200 also includes a bracket 250. Bracket 250 can be constructed of or with any suitable material. For example, bracket 250 may be constructed of or with steel. As discussed in greater detail below, bracket 250 may be mounted to fixed to door 128, e.g., outer panel 203 of door 128. Bracket 250 includes a back plate 252 and a projection 254. Back plate 252 may be positioned at or adjacent refrigerator door 128, e.g., outer panel 203 of door 128, to assist with mounting bracket 250 to refrigerator door 128. Projection 254 extends away from back plate 252, e.g., along the transverse direction T, towards insert 220. Projection 254 is sized, shaped and/or oriented for receipt within channel 224 of insert 220. Thus, projection 254 can slide into channel 224 of insert 220 during mounting of insert 220 to bracket 250. In particular, front portion 264 of channel 224 is tapered for receiving and guiding projection 254 into channel 224.

As may be seen in FIGS. 4 and 5, projection 254 defines a hole 256. Hole 256 is sized and shaped for receiving pin 230, e.g., distal end 234 of pin 230. Thus, distal end 234 of pin 230 may be at least partially positioned within hole 256 of projection 254 when projection 254 is positioned or disposed within channel 224 of insert 220.

Figure 7:
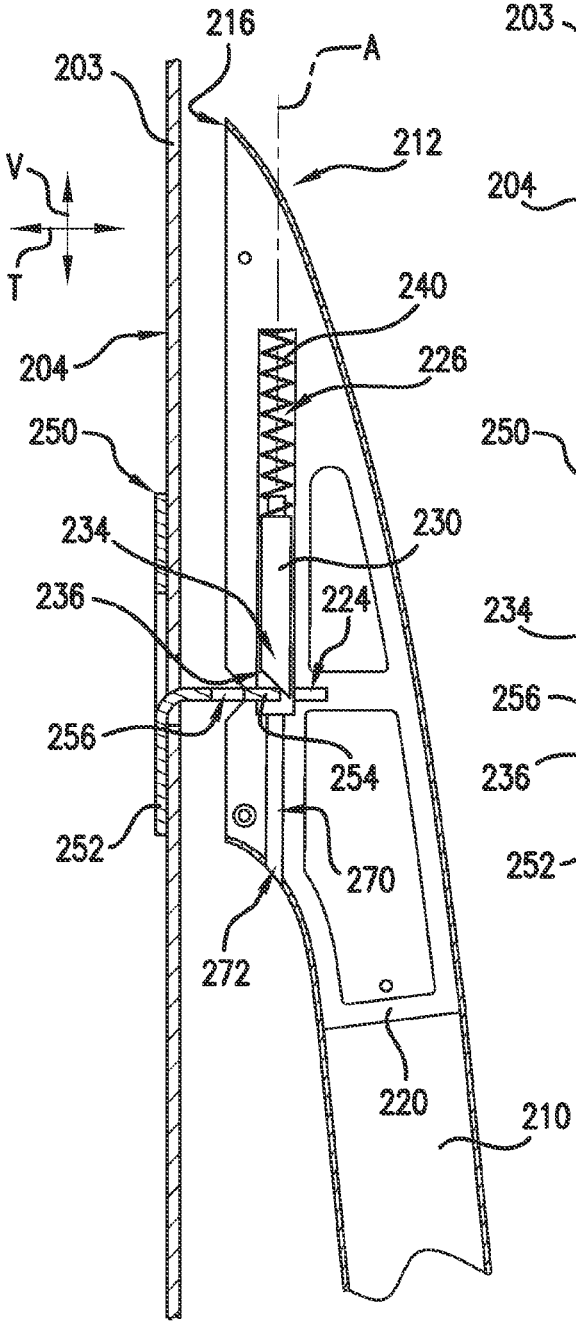
Figure 8:
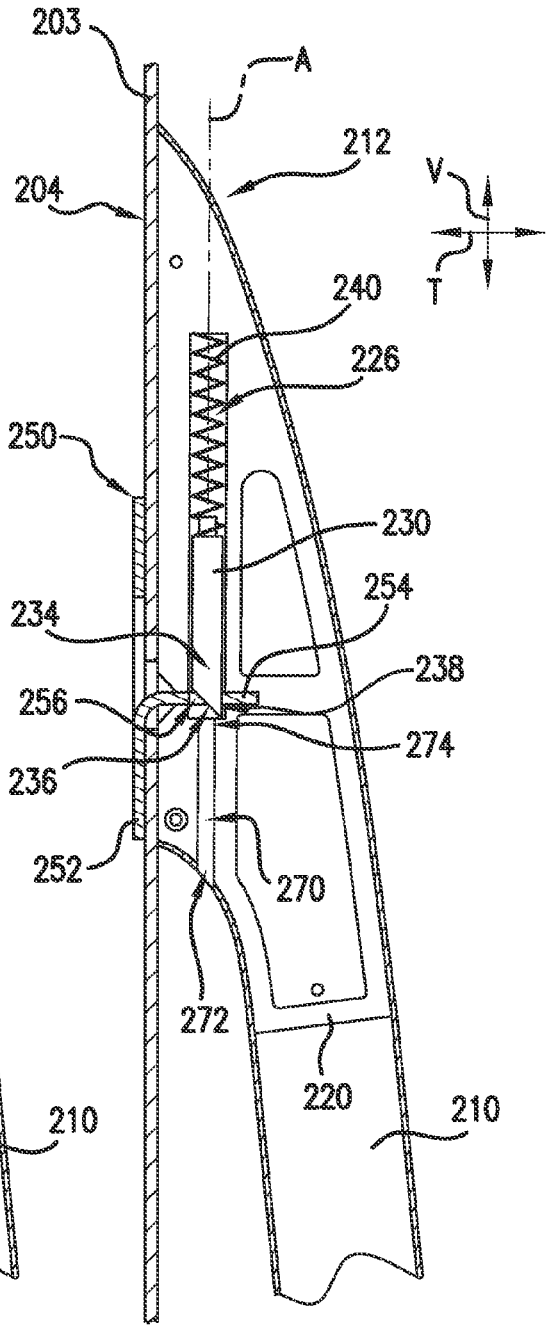

FIGS. 6, 7 and 8 provide partial, section views of handle assembly 200 shown in various stages of mounting handle assembly 200 to outer panel 203. In FIG. 6, tubular main body 210 is shown spaced apart from outer panel 203. In FIG. 7, projection 254 of bracket 250 is shown partially inserted into channel 224 of insert 220. In FIG. 8, handle assembly 200 is shown mounted to outer panel 203.

As may be seen in FIGS. 6, 7 and 8, back plate 252 is positioned on or at a back surface 204 of outer panel 203. Projection 254 of bracket 250 extends from back plate 252 through outer panel 203. Back plate 252 can hinder motion of projection 254 along the transverse direction T. For example, back plate 252 can impact outer panel 203 and hinder or prevent tubular main body 210 from pulling away from outer panel 203 when tubular main body 210 is mounted to outer panel 203 as shown in FIG. 8.

To mount tubular main body 210 to outer panel 203, an installer can align projection 254 of bracket 250 with channel 224 of insert 220 along the vertical direction V as shown in FIG. 6. With the projection 254 and channel 224 properly aligned, the installer moves inert 220 and tubular main body 210 towards outer panel 203 and bracket 250, e.g., along the transverse direction T until projection 254 enters channel 224.

Turning now to FIG. 6, projection 254 engages pin 230 within channel 224 as projection 254 is inserted into channel 224. In particular, projection 254 impacts and engages angled leading edge 236 of pin 230 as projection 254 is inserted into channel 224. When projection 254 engages angled leading edge 236, angled leading edge 236 can ride on projection 254 such that pin 230 moves or slides, e.g., upwardly, within passage 226 of insert 220 despite biasing mechanism 240 urging pin 230 in an opposite direction, e.g., downwardly. With pin 230 repositioned due to projection 254 being inserted into channel 224, the installer can continue to move inert 220 and tubular main body 210 towards outer panel 203 and bracket 250, e.g., along the transverse direction T, until first end portion 212 of tubular main body 210 and/or mounting surface 222 of insert 220 are positioned at or adjacent outer panel 203.

Biasing mechanism 240 urges distal end 234 of pin 230 into hole 256 of projection 254, e.g., when hole 256 is disposed below pin 230 or when hole 256 aligns with pin 230 along the vertical direction V. When pin 230 is positioned or disposed within hole 256, pin 230 hinders movement of insert 220 and tubular main body 210, e.g., along the transverse direction T. In particular, opposite surface 238 of pin can engage projection 254 at hole 256 of projection 254. Due to angle α of passage 226, pin 230 can engage projection 254 at an angle between five degrees or ten degrees. Such angling can keep pin 230 tight against projection 254 at hole 256 of projection 254. In such a manner, pin 230 can take up or reduce clearances in a tolerance stack of handle assembly 200 and limit slack or play within handle assembly 200. Biasing mechanism 240 also continues to urge pin 230 into hole 256 of projection 254 in order to keep insert 220 and tubular main body 210 mounted to outer panel 203. In such a manner, tubular main body 210 of handle assembly 200 can be snapped onto outer panel 203.

As may be seen in FIG. 6, insert 220 defines an access hole 270. Access hole 270 extends from tubular main body 210 to channel 224 of insert 220. In particular, access hole 270 extends between an entrance 272 and an exit 274. Exit 274 of access hole 270 is positioned at or adjacent distal end 234 of pin 230, e.g., when pin 230 is positioned or disposed in hole 256 of projection 254. To remove insert 220 and tubular main body 210 from outer panel 203, a rod or other elongated tool can be inserted into and through access hole 270 until the tool lifts pin 230 out of hole 256 of projection 254. With pin removed 230, pin 230 no longer hinders movement of insert 220 and tubular main body 210, e.g., along the transverse direction T, and the user can remove insert 220 and tubular main body 210 from outer panel 203.

Figure 9:
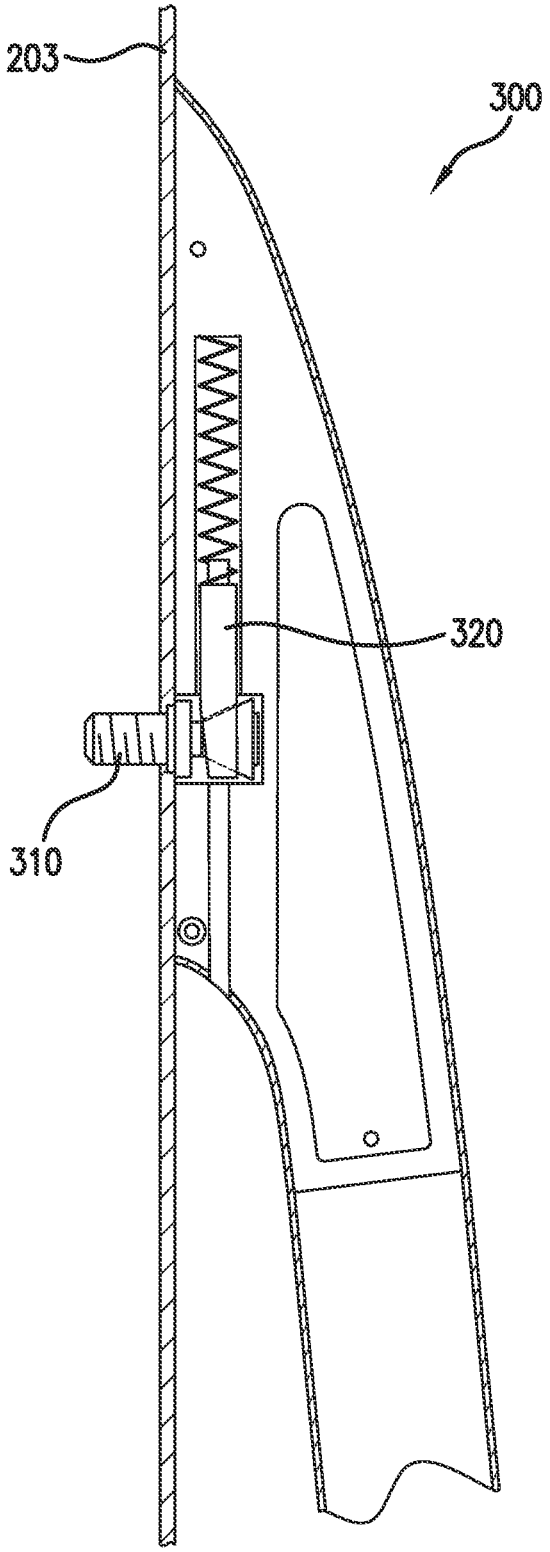
FIG. 9 provides a partial, section view of a handle assembly according to another exemplary embodiment of the present subject matter.

FIG. 9 provides a partial, section view of a handle assembly 300 according to another exemplary embodiment of the present subject matter. Handle assembly 300 is similar to handle assembly 200 (FIG. 6) and includes similar components and features. As may be seen in FIG. 9, handle assembly 300 includes a projection or post 310 mounted to outer panel 203. In particular, post 310 is threaded onto outer panel 203. A pin 320 of handle assembly 300 engages post 310. In particular, pin 320 can be forked, and pin 320 can be disposed between tines of pin 320 to couple pin 320 to post 310.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An appliance defining a vertical direction and a transverse direction, the vertical and transverse directions being perpendicular to each other, the appliance comprising:

a cabinet;

a door mounted to the cabinet, the door having an outer panel;

a handle assembly mounted to the door, the handle assembly comprising a tubular main body extending between a first end portion and a second end portion, the first and second end portions of the tubular main body spaced apart from each other along the vertical direction, the first and second end portions of the tubular main body positioned at the outer panel of the door, the tubular main body defining an opening at the first end portion of the tubular main body;

an insert received within the tubular main body at the first end portion of the tubular main body, the insert having a mounting surface positioned at the opening of the tubular main body, the mounting surface positioned proximate the outer panel of the door, the insert defining a channel that extends inwardly from the mounting surface of the insert, the insert also defining a passage that extends from the channel of the insert along the vertical direction;

a pin slidably disposed within the passage of the insert, the pin having a distal end;

a biasing mechanism urging the distal end of the pin towards the channel of the insert; and a bracket mounted to the door, the bracket having a projection that defines a hole, the projection disposed within the channel of the insert, the distal end of the pin at least partially positioned within the hole of the projection.

2. The appliance of claim 1, wherein the pin defines an angled leading edge that faces the mounting surface of the insert.

3. The appliance of claim 2, wherein the angled leading edge of the pin engages the projection when the projection is inserted into the channel such that the pin moves into the passage until biasing mechanism urges the distal end of the pin into hole of the projection.

4. The appliance of claim 1, wherein the passage extends between a top portion and a bottom portion along the vertical direction, the channel extending between a front portion and a back portion along the transverse direction, the top portion of passage positioned above the channel along the vertical direction, the bottom portion of the passage positioned at the channel such that the bottom portion of the passage is disposed between the front and back portions of the channel along the transverse direction.

5. The appliance of claim 1, wherein a central axis of the passage and the vertical direction define an angle α therebetween, the angle α being greater than five degrees and less than fifteen degrees.

6. The appliance of claim 1, wherein the biasing mechanism comprises a spring positioned within the passage and extending between the insert and the pin.

7. The appliance of claim 1, wherein the insert defines an access hole that extends to the channel of the insert, an exit of the access hole positioned at the distal end of the pin.

8. The appliance of claim 1, wherein the bracket comprises a back plate, the back plate positioned at a back surface of the outer panel, the projection extending from the back plate through the outer panel of the door to the channel of the insert.

9. The appliance of claim 1, wherein the tubular main body comprises stainless steel and the insert comprises a plastic.

10. A handle assembly for an appliance, the handle assembly defining a vertical direction, and a transverse direction, the vertical and transverse directions being perpendicular to each other, the handle assembly comprising:

a tubular main body that extends between a first end portion and a second end portion, the first and second end portions of the tubular main body spaced apart from each other along the vertical direction, the tubular main body defining an opening at the first end portion of the tubular main body;

an insert received within the tubular main body at the first end portion of the tubular main body, the insert having a mounting surface positioned at the opening of the tubular main body, the insert defining a channel that extends inwardly from the mounting surface of the insert, the insert also defining a passage that extends from the channel of the insert along the vertical direction;

a pin disposed within the passage of the insert, the pin movable between a first position and a second position within the passage, the pin having a distal end positioned in the channel of the passage when the pin is in the second position;

a biasing mechanism urging the pin towards the second position;

a bracket having a projection, the projection disposed within the channel of the insert, the distal end of the pin engaging the projection within the channel of the insert.

11. The handle assembly of claim 10, wherein the passage extends between a top portion and a bottom portion along the vertical direction, the channel extending between a front portion and a back portion along the transverse direction, the top portion of the passage positioned above the channel along the vertical direction, the bottom portion of the passage positioned at the channel such that the bottom portion of the passage is disposed between the front and back portions of the channel along the transverse direction.

12. The handle assembly of claim 10, wherein a central axis of the passage and the vertical direction define an angle $\alpha$ therebetween, the angle $\alpha$ being greater than five degrees and less than fifteen degrees.

13. The handle assembly of claim 10, wherein the pin defines an angled leading edge that faces the mounting surface of the insert.

14. The handle assembly of claim 10, wherein the biasing mechanism comprises a spring positioned within the passage and extending between the insert and the pin.

15. The handle assembly of claim 10, wherein the insert defines an access hole that extends to the channel of the insert, an exit of the access hole positioned at the distal end of the pin.

16. The handle assembly of claim 10, wherein the tubular main body comprises stainless steel and the insert comprises a plastic.

* * * * *